US007882786B2

(12) United States Patent
DeHaan et al.

(10) Patent No.: US 7,882,786 B2
(45) Date of Patent: Feb. 8, 2011

(54) PAINTBALL

(75) Inventors: David DeHaan, San Diego, CA (US); Eero Kaakkola, San Diego, CA (US)

(73) Assignee: Dye Precision, Inc., San Diego, CA (US)

( * ) Notice: Subject to any disclaimer, the term of this patent is extended or adjusted under 35 U.S.C. 154(b) by 0 days.

(21) Appl. No.: 12/207,255

(22) Filed: Sep. 9, 2008

(65) Prior Publication Data

US 2010/0058948 A1 Mar. 11, 2010

(51) Int. Cl.
*F42B 8/14* (2006.01)

(52) U.S. Cl. ..... 102/513

(58) Field of Classification Search ..... 124/56; 473/383, 384; 102/370, 444, 502, 513
See application file for complete search history.

(56) References Cited

U.S. PATENT DOCUMENTS

| | | | | | |
|---|---|---|---|---|---|
| D237,094 | S | * | 10/1975 | Martin | D21/709 |
| 4,560,168 | A | * | 12/1985 | Aoyama | 473/379 |
| 5,001,880 | A | | 3/1991 | Smith | |
| 5,249,804 | A | | 10/1993 | Sanchez | |
| 5,254,379 | A | | 10/1993 | Kotsiopoulos et al. | |
| 5,353,712 | A | | 10/1994 | Olson | |
| 5,448,951 | A | | 9/1995 | Olson | |
| 5,544,890 | A | | 8/1996 | Shaw et al. | |
| 5,639,526 | A | | 6/1997 | Kotsiopoulos et al. | |
| 5,823,173 | A | * | 10/1998 | Slonaker et al. | 124/56 |
| 5,957,786 | A | | 9/1999 | Aoyama | |
| 6,145,441 | A | * | 11/2000 | Woodall et al. | 102/502 |
| 6,230,630 | B1 | | 5/2001 | Gibson et al. | |
| 6,393,992 | B1 | * | 5/2002 | Vasel et al. | 102/502 |
| 6,574,945 | B2 | | 6/2003 | Martinez, Jr. | |
| D501,901 | S | * | 2/2005 | Yu | D21/713 |
| 6,849,007 | B2 | | 2/2005 | Morgan et al. | |
| D510,966 | S | * | 10/2005 | Michishita | D21/709 |
| 7,017,497 | B1 | | 3/2006 | Gardner, Jr. | |
| 7,520,824 | B2 | * | 4/2009 | Kasashima | 473/384 |
| 7,594,867 | B2 | * | 9/2009 | Nardacci | 473/383 |
| 2005/0266934 | A1 | * | 12/2005 | Morgan et al. | 473/383 |
| 2006/0005732 | A1 | | 1/2006 | Forster | |
| 2006/0089211 | A1 | * | 4/2006 | Sato et al. | 473/378 |
| 2007/0259739 | A1 | * | 11/2007 | Kasashima et al. | 473/384 |
| 2009/0075760 | A1 | * | 3/2009 | Morgan et al. | 473/383 |

* cited by examiner

*Primary Examiner*—Michael Carone
*Assistant Examiner*—Reginald Tillman, Jr.
(74) *Attorney, Agent, or Firm*—Knobbe, Martens, Olson & Bear LLP

(57) ABSTRACT

A paintball has one or more dimples or depressions formed on the outer surface of the paintball. In some embodiments, the depressions can have a uniform or non-uniform shape and be spaced equally about the circumference of the paintball. In some embodiments, each depression may provide increased lift and/or fragility to the paintball.

25 Claims, 12 Drawing Sheets

PAINTBALL

BACKGROUND OF THE INVENTION

1. Field of the Invention

The present invention relates to projectiles for a pneumatic gun. More specifically, this invention relates to a paintball for use with a paintball marker.

2. Description of the Related Art

This invention relates to paintballs for pneumatic paintball markers. Paintballs and paintball markers are typically used for target practice and in mock war games. Paintballs are spherical projectiles that are propelled out of the barrel of the paintball markers by a burst of compressed gas, such as air or nitrogen. Paintballs are typically approximately 0.68 inch in diameter with a smooth outer surface, and are comprised of a non-toxic, colored liquid enclosed in a fragile gelatin casing. The paintballs are designed to rupture upon impact so as to mark the target.

In the sport known as "Paintball," the paintballs are fired at an opponent and burst upon contact so that the colored liquid is deposited on the opponent, scoring a hit for the combatant. All the participants involved in the sport are required to wear an abundance of protective gear, to prevent paintballs from hitting vital parts of the player's anatomy. The sport of paintball has become very popular within a relatively short period of time, but there is still a need for a paintball with improved features. In particular, there is a need for a paintball with improved flight and other performance characteristics.

SUMMARY OF THE INVENTION

The systems and methods of the present invention have several features, no single one of which is solely responsible for its desirable attributes. Without limiting the scope of this invention as expressed by the claims which follow, its more prominent features will now be discussed briefly. After considering this discussion, and particularly after reading the section entitled "Detailed Description of the Preferred Embodiments" one will understand how the features of this invention provide several advantages over traditional paintballs.

One aspect of the present invention involves a paintball that has a shell. The shell has a generally spherical outer surface. The paintball further has a marking substance within the shell and a plurality of dimples formed on the outer surface.

Another aspect of the present invention is a paintball that has a gelatinous hollow shell. The shell has an outer surface. The paintball further includes a marking substance disposed in the shell and at least one dimple formed on the outer surface.

Another aspect is a method of forming a paintball. The method comprises forming a quantity of a marking substance into a desired shape and forming a shell around the marking substance. The shell has an outer surface that is generally spherical in shape and includes a plurality of dimples formed on the outer surface.

Another aspect is a method of forming a paintball. The method comprises forming a shell that has a generally spherically shaped outer surface. The paintball further comprises a marking substance within the shell. The shell has a plurality of dimples formed on the outer surface.

BRIEF DESCRIPTION OF THE DRAWINGS

These and other features, aspects and advantages of the present invention will now be described in connection with preferred embodiments of the invention, in reference to the accompanying drawings. The illustrated embodiments, however, are merely examples and are not intended to limit the invention. The following are brief descriptions of the drawings.

DETAILED DESCRIPTION OF THE PREFERRED EMBODIMENTS

Figure 1A:
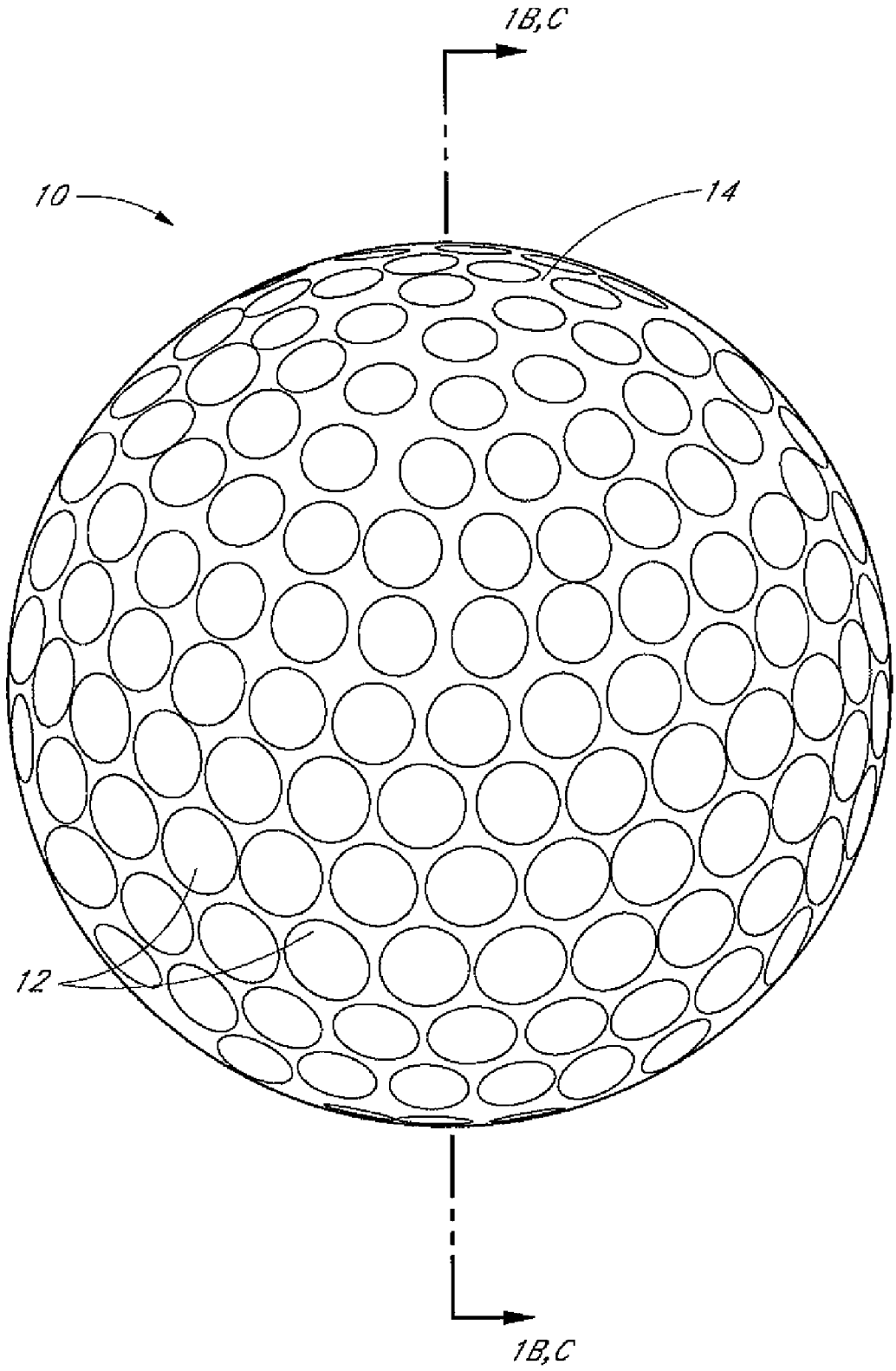
FIG. 1A is a perspective view of a paintball having a plurality of depressions on an outer surface according to an embodiment of the present invention.

The following detailed description is now directed to certain specific features of the embodiments. In this description, reference is made to the drawings wherein like parts are designated with like numerals throughout the description and the drawings.

The present invention relates to a paintball that has an outer surface with one or more dimples or depressions. In contrast to a paintball that has a smooth outer surface, a dimpled outer surface improves the performance of the paintball. For example, dimples reduce the air drag experienced by the paintball, as well as increase the lift experienced by the paintball during flight. As described above, paintballs are typically approximately 0.68 inch at the outer diameter and comprise a spherical, gelatinous outer shell that generally encapsulates a colored substance in the interior of the shell. Because paintballs are designed to break open and disperse the colored substance upon impact with a target, the outer shell is preferably fairly thin. However, the dimpled paintball embodiments described herein are not so limited. The embodiments of paintballs described herein may be formed in any desired shape or size, and may comprise any material, whether it is conventionally known, later developed, or otherwise, for manufacturing paintballs. Further, the dimples described herein may have sizes, depths, or shapes that will enhance the performance characteristics of the paintball, including but not limited to accuracy, lift, drag reduction, speed, distance, burst, or other performance characteristics.

The outer shell may have a continuous thickness or may have a thickness that varies around the circumference of the paintball. For example, the thickness of the outer shell may be thinned or reduced in the regions of the dimples and thicker between dimples. Of course the inner wall of the paintball can have a wavy contour such that the outer shell between dimples has the same thickness or is thicker than the outer shell in the regions of the dimples. While the specification mentions a plurality of dimples or depressions, each depression need not have the same size, depth from the circumference, or shell thickness. For example, some embodiments may have a plurality of dimples with some dimples having a depth from the outer circumference greater than the depth of other dimples. The bottom surface of a dimple may be coaxially aligned with a center point of the entire dimple or offset from the center point of the dimple.

Further, the term dimple or depression is used to describe a location on the outer surface of the paintball that is offset towards the center of the paintball relative to the outer circumference or adjacent surface protrusions. For example, the term dimple or depression includes a region of the outer surface disposed between protrusions that extend away from the center of the paintball. In this way, the depressions are defined by the valleys between the protrusions. Thus, dimples or protrusion may have a circular shape or non-circular shape and need not have a bottom surface that is closer to the center of the paintball than an average outer circumference. For example, the bottom surface of the dimple can be tangent to the average outer circumference with protrusions extending on one or sides of the dimple in a direction away from the center of the paintball.

In particular, each dimple may have a spherical, triangular, tetrahedral, rectangular, linear or other shape conventionally known or later developed. A dimple may have a generally linear shape that forms a groove or channel. For example, a dimple in the shape of a groove or channel may have a length that is greater than a width of the dimple. A locally thinning of the paintball in the region of the groove, dimple, or dimple may advantageously create a stress riser in the dimpled region. The stress riser results in a concentration of stresses occurring in the region of the protrusion upon impact and increases the likelihood that the paintball will initially fail in the region of the dimple. Such a paintball may be said to be more fragile.

Further, the paintballs and dimples may be configured to alter the flight path of the paintballs. A user may deploy particular paintballs that tend to curve in a desired direction, depending on the weight characteristics of the paintball and the configuration of the dimples.

The specific details of the illustrated embodiments will now be described but should be used to limit the geometry and/or spacing of the illustrated surface features. Further, the dimples in the illustrated embodiments appear generally symmetrical. However, the dimples are not limited to having a symmetrical shape and may have asymmetrical shapes. Further, symmetrically shaped dimples may be mixed with asymmetric dimples on a single paintball.

FIG. 1A depicts a perspective view of a paintball 10 having a plurality of approximately equally spaced depressions or dimples 12 on the surface 14 thereof. As illustrated in FIG. 1A, each dimple defines a radius that is approximately 0.1 inch and a maximum depth that is approximately 0.05 inch. Of course other dimension and depths, such as 0.2 inch and 0.10 inch, may be used.

Figure 1B:
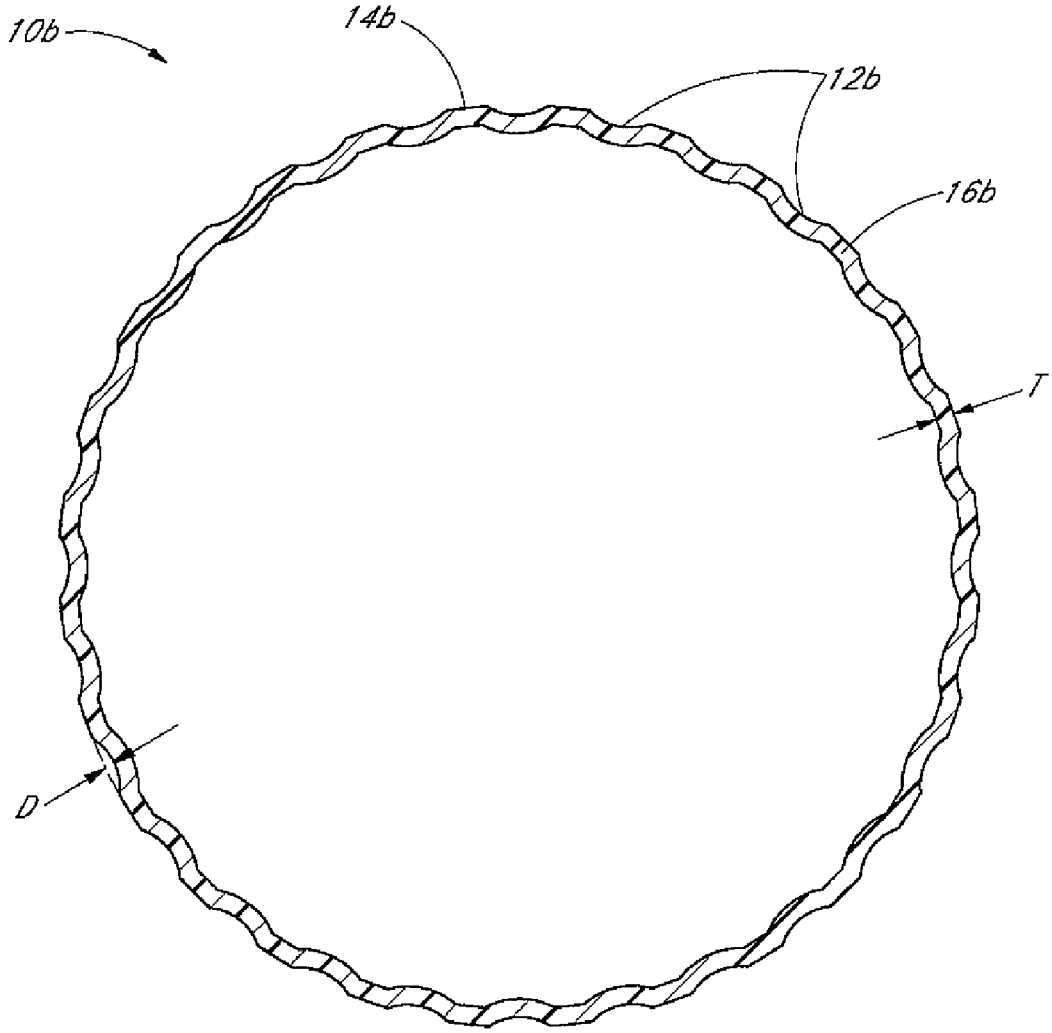
FIG. 1B is a sectional view of the paintball of FIG. 1A taken along the line 1B-1B and shows a shell that has a uniform thickness around its circumference.

FIG. 1B is a sectional view of an embodiment of the paintball 10 shown in FIG. 1 through the line 1B-1B. As illustrated in FIG. 1B, the paintball 10*b* has a shell 16*b* with a uniform thickness "T" throughout the entire paintball 10*b*. In this configuration, the thickness "T" of the shell 16*b* is approximately the same at the location of each dimple 12*b* as the thickness "T" of the shell 16*b* between each dimple 12*b*. As illustrated in FIG. 1B, the depth "D" of the dimple 12*b*, measured from the outer surface 14*b* to the lowest point in the dimple 12*b*, is approximately 50% of the approximately thickness "T" of the shell 16*b*.

Figure 1C:
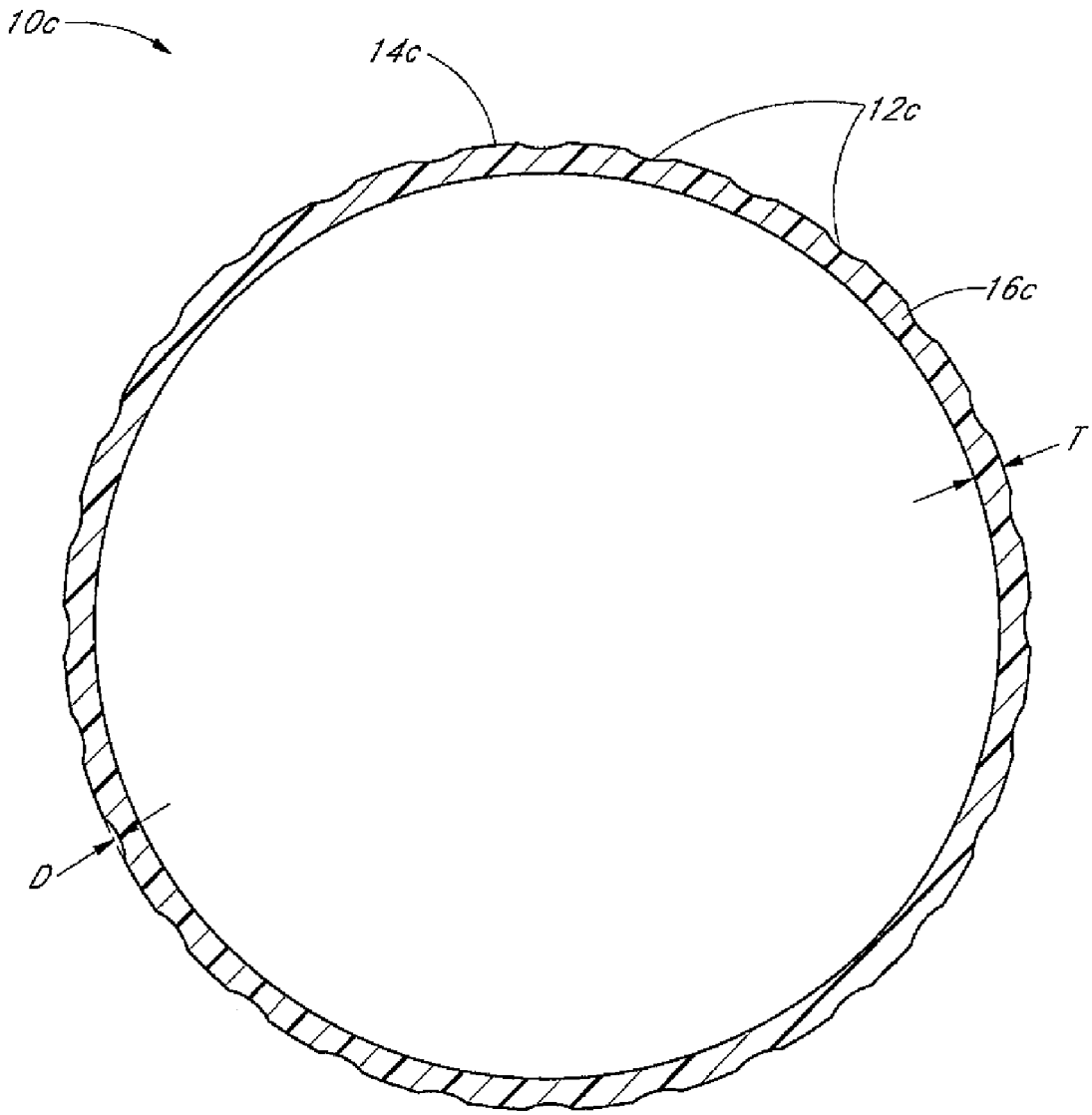
FIG. 1C is an alternative sectional view of another embodiment of the paintball of FIG. 1A taken along the line 1C-1C and shows a shell that has a varying thickness around its circumference.

Alternatively, as illustrated in FIG. 1C, the paintball 10*c* can be configured such that the thickness "T" of the shell 16*c* is non-uniform or variable. In particular, the paintball 10*c* can be configured such that the thickness "T" of the shell 16*c* is reduced at the location of each dimple 12*c* by an amount equal to the depth "D" of the respective dimple 12*c*. In the illustrated configuration, the depth "D" of the dimple 12*c*, measured from the outer surface 14*c* to the lowest point in the dimple 12*c*, is approximately 20% of the approximately thickness "T" of the shell 16*c*. Any of the embodiments of paintballs described herein can be configured with the uniform or non-uniform shell thickness described herein.

The thickness "T" of the shell 16*c* need not be reduced by an amount equal to the depth "D" of the respective dimple 12*c* if the inside surface of the shell 16*c* is wavy as is illustrated in FIG. 1B. In such an embodiment, the thickness "T" need only be reduced in the region of the dimple 14*c*.

In the embodiment illustrated in FIG. 1A, each dimple is configured such that the depth of each dimple 12 from the paintball surface (i.e., outer surface) 14 is less than the radius defining the dimple 12. Of course the geometry of each dimple 12 is not limited to the illustrated embodiments.

Each dimple 12 may be configured to define a radius that is approximately 0.005 inch to approximately 0.01 inch, or approximately 0.01 inch to approximately 0.1 inch, or approximately 0.1 inch to approximately 0.5 inch or more, or approximately 0.5 inch to approximately 1.0 inch or more, and a maximum depth from the surface 14 of the paintball 20 that is approximately 0.005 inch to approximately 0.025 inch, or approximately 0.025 inch to approximately 0.05 inch, or approximately 0.05 inch to approximately 0.1 inch or greater. Alternatively, the dimples on any of the embodiments illustrated or described herein can be configured such that the maximum depth of each dimple is less than approximately 10% of the approximate thickness of the shell, or approximately 10% to approximately 20% of the approximate thickness of the shell, or approximately 20% to approximately 30%, or approximately 30% to approximately 50%, or approximately 50% to approximately 70%, or greater than approximately 70% of the approximate thickness of the shell. However, the embodiments illustrated and described herein are not so limited. The dimples can be configured to define any radius or depth that will enhance the performance characteristics of the paintball, including but not limited to accuracy, lift, spin, speed, distance, burst, or other performance characteristics.

In some embodiments illustrated and described herein, approximately 60% to approximately 80% of the paintball surface 14 is covered with dimples 12. In other embodiments, approximately 20% to approximately 40%, or approximately 40% to approximately 60%, or approximately 80% to approximately 95% of the paintball surface 14 may be covered with dimples 12.

As discussed above, the paintball 10 illustrated in FIG. 1A is configured such that the dimples 12 preferably have an approximately uniform radii and depth, and are positioned on the surface 14 of the paintball 10 at equidistant intervals. With reference to FIGS. 2 through 9, other dimple patterns will now be described. While a single view of each dimple pattern is provided, it should be understood that the pattern repeats uniformly throughout the circumference of the paintball.

Figure 2:
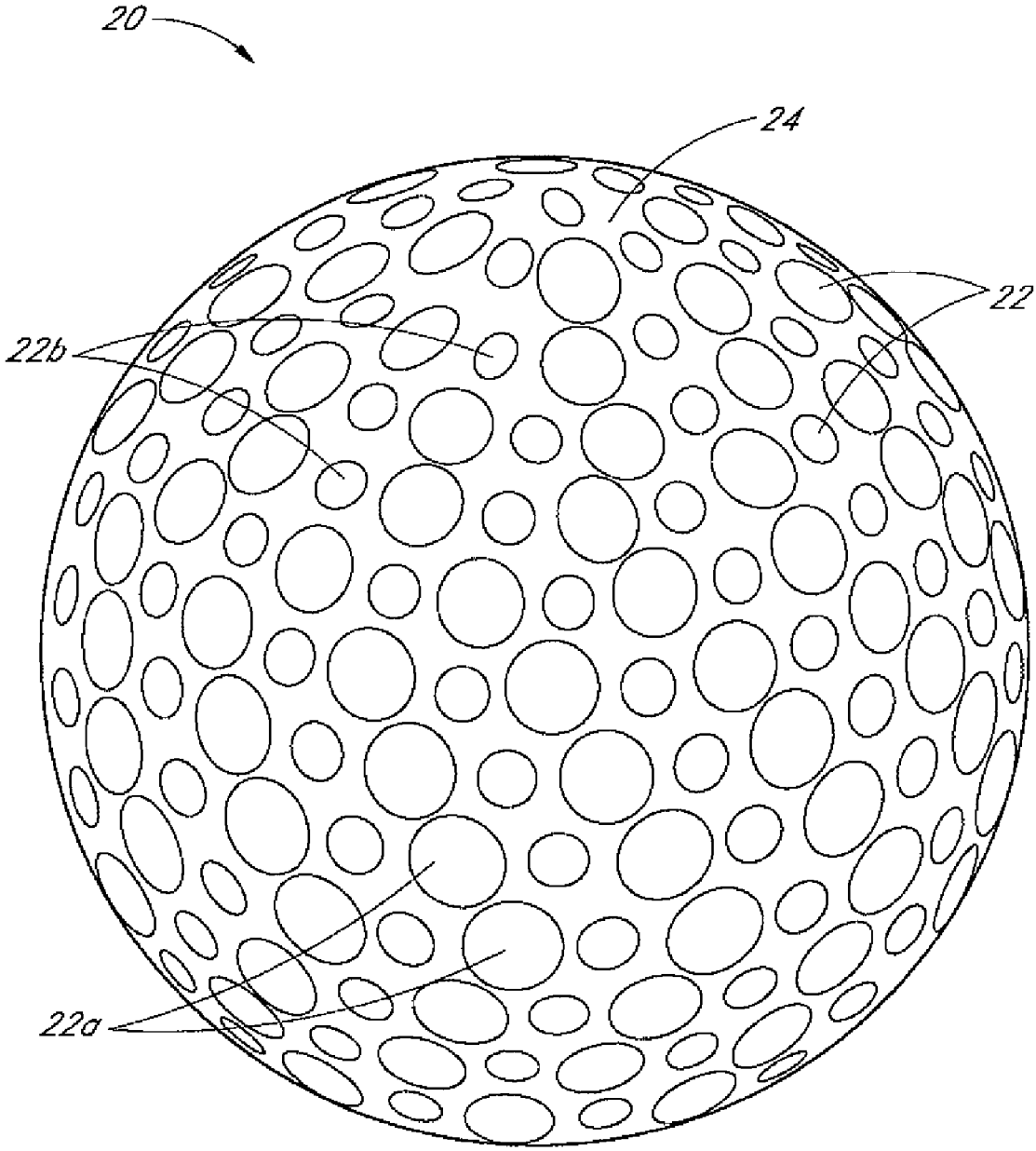
FIG. 2 is a perspective view of another embodiment of a paintball having a plurality of dimples spaced about the outer surface and having varying radii and depths.

FIG. 2 depicts a perspective view of a paintball 20 preferably having a plurality of dimples 22 approximately equally spaced about the paintball surface 24, but having varying radii and depths. In particular, dimples 22*a* each preferably have a radius that is approximately 0.1 inch, while dimples 22*b* each have a radius this is approximately 0.05 inch. The depth of each dimple 22*a* is preferably approximately 0.05 inch, while the depth of each dimple 22*b* is approximately 0.025 inch. In other embodiments, the dimples 22*a*, 22*b* can be arranged such that they are spaced apart at different distances (either uniform or non-uniform distances between the dimples) as compared to the illustrated embodiment. In yet other embodiments, the paintball surface 24 can comprise additional dimples 22 having a different radius or depth as compared to dimples 22*a*, 22*b*, and can be arranged such that they are spaced at either uniform or non-uniform distances from the other dimples 22.

Figure 3:
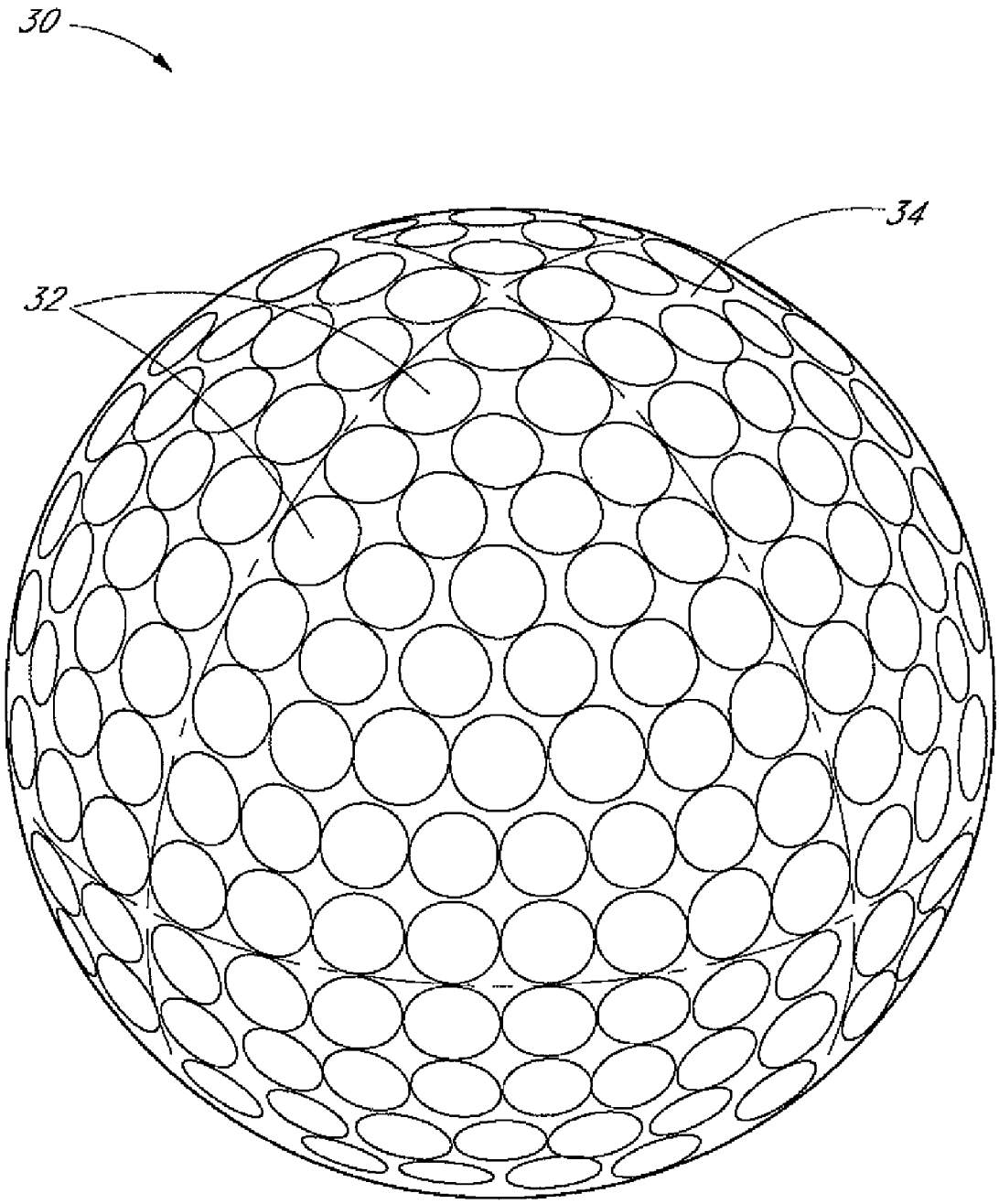
FIG. 3 is a perspective view of another embodiment of a paintball having a plurality of dimples generally arranged in triangular patterns.

FIG. 3 depicts a perspective view of a paintball 30 preferably having a plurality of dimples 32 on the surface 34 thereof generally arranged in triangular patterns. As illustrated, the surface 34 of the paintball 30 is preferably divided into eight approximately equilateral triangles, with each triangle preferably comprising a plurality of dimples 32 arranged as illustrated. In other embodiments, the paintball surface 34 can comprise additional dimples having a different radius or depth as compared to dimples 32 illustrated in FIG. 3, and can be arranged such that they are spaced at either uniform or non-uniform distances from the other dimples 32 and at a distance that is equal to, greater than, or less than the spacing in the illustrated embodiment.

Figure 4:
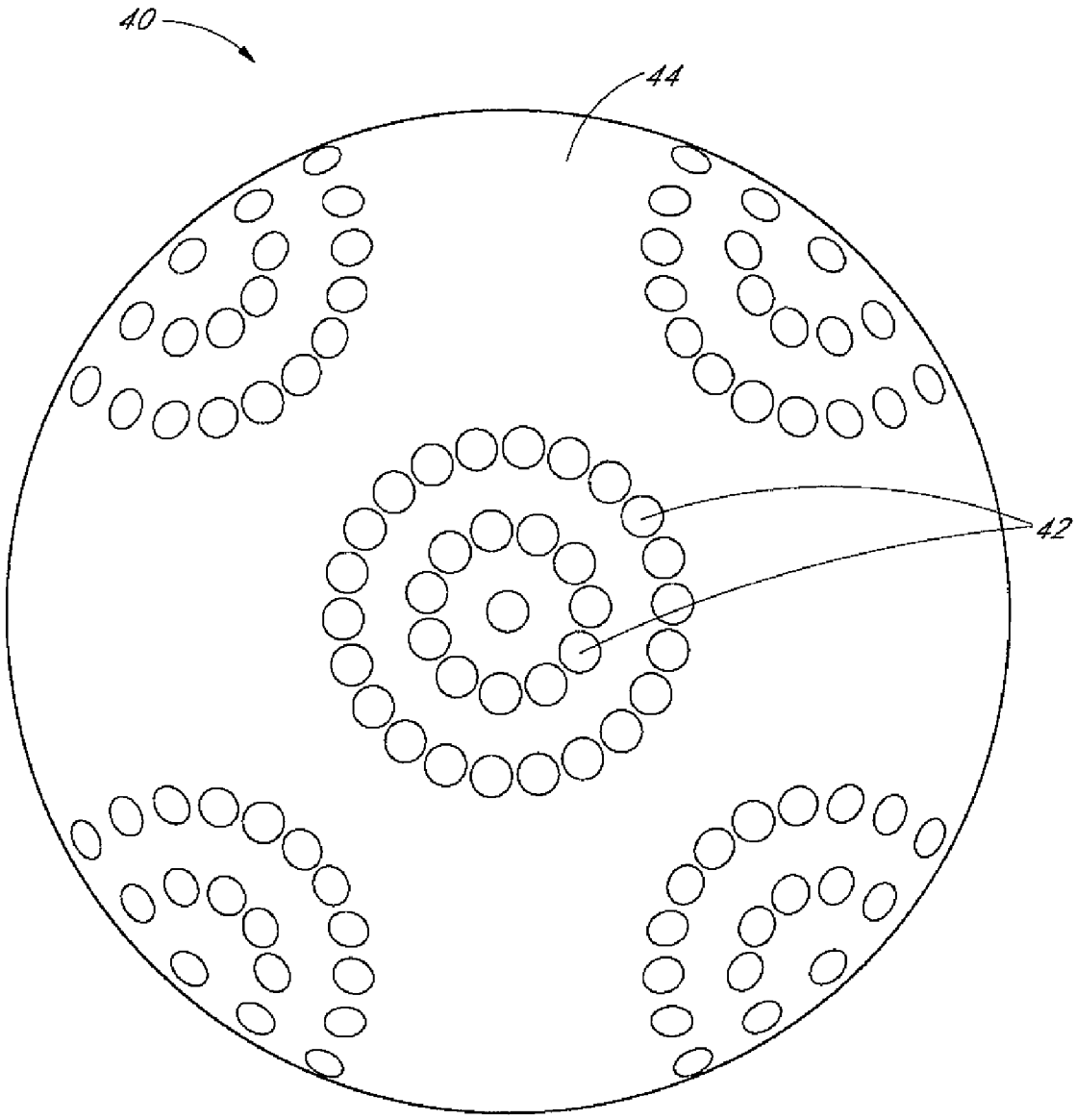
FIG. 4 is a perspective view of another embodiment of a paintball having a plurality of dimples generally arranged in the pattern of groups of concentric circles.

FIG. 4 depicts a perspective view of a paintball 40 preferably having a plurality of dimples 42 on the surface 44 thereof generally arranged in the pattern of groups of concentric circles, as shown. The dimples 42 illustrated in FIG. 4 generally have equal radii and depths, but the paintball 40 is not so limited. Paintball 40 can comprise dimples configured to have any of a wide ranging variety of radii, depths, and spacing suitable to achieve the desired performance characteristics of the paintball.

Figure 5:
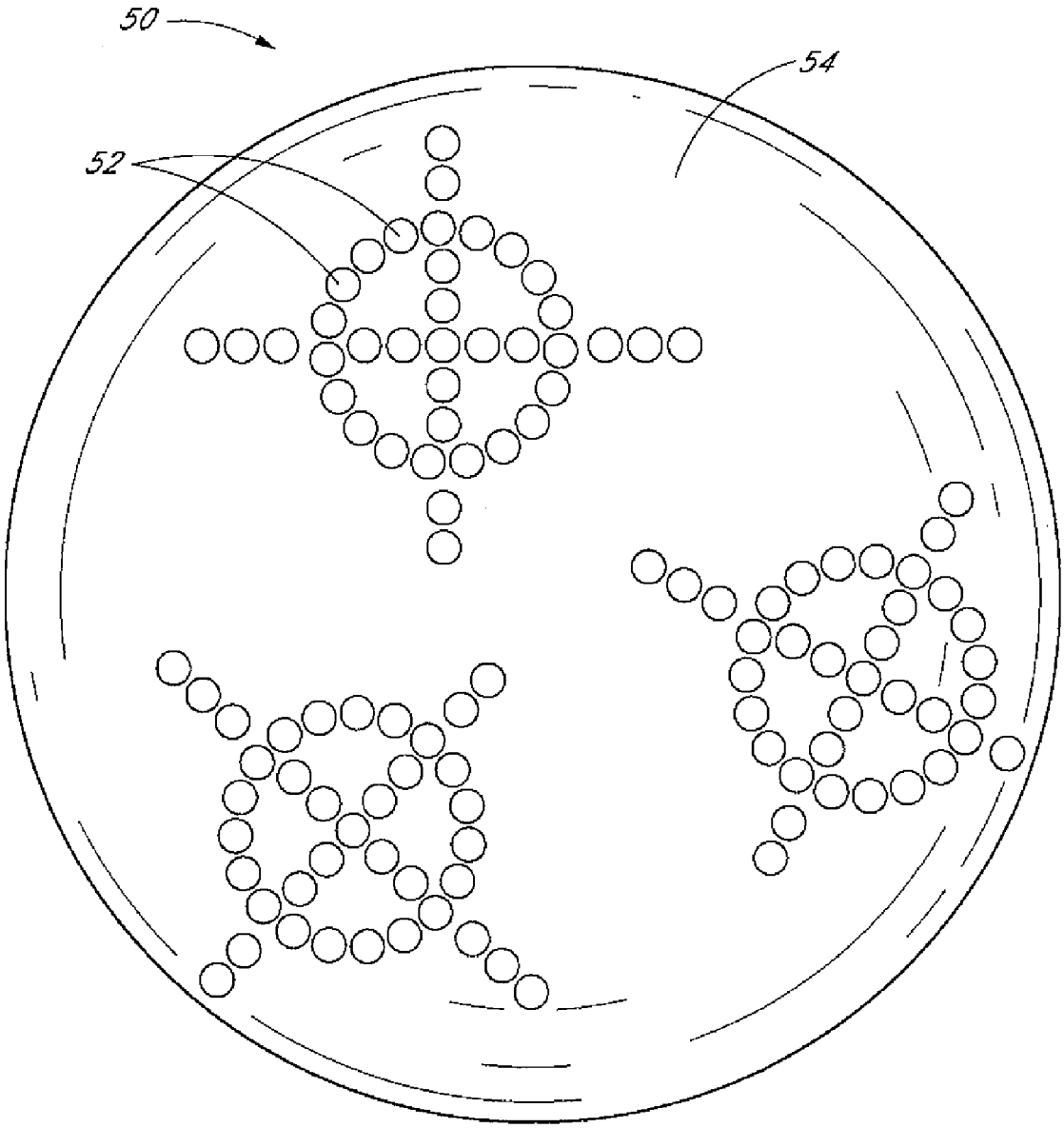
FIG. 5 is a perspective view of another embodiment of a paintball having a plurality of dimples generally arranged in a bull's eye pattern.

FIG. 5 depicts a perspective view of a paintball 50 preferably having a plurality of dimples 52 on the surface 54 thereof arranged generally as shown. The dimples 52 illustrated in FIG. 5 generally have equal radii and depths, but the paintball 50 is not so limited. Paintball 50 can comprise dimples configured to have any of a wide ranging variety of radii, depths, and spacing suitable to achieve the desired performance characteristics of the paintball.

Figure 6:
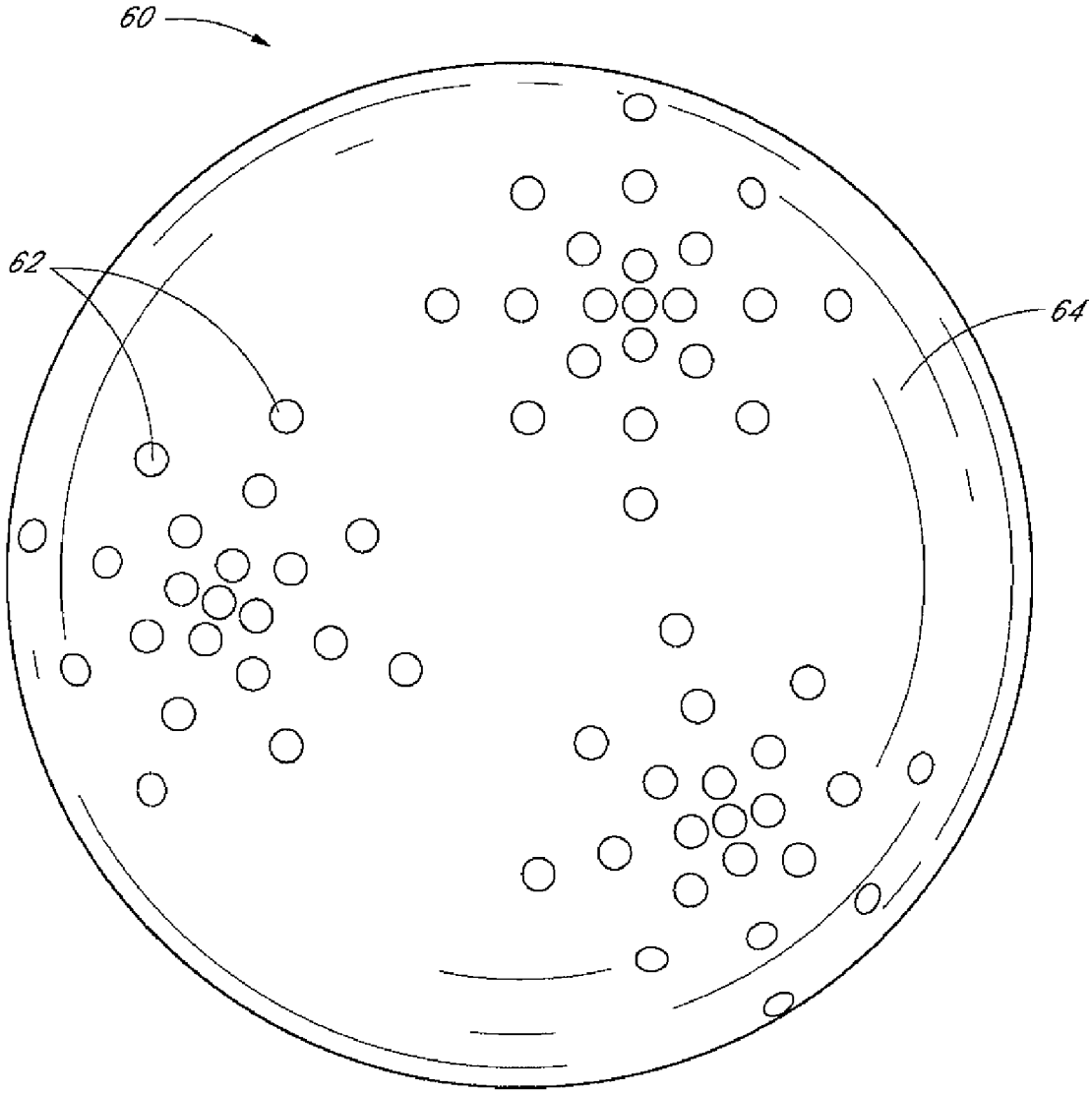
FIG. 6 is a perspective view of another embodiment of a paintball.

FIG. 6 depicts a perspective view of a paintball 60 preferably having a plurality of dimples 62 on the surface 64 thereof arranged generally as shown. The dimples 62 illustrated in FIG. 6 generally have equal radii and depths, but the paintball 60 is not so limited Paintball 60 can comprise dimples configured to have any of a wide ranging variety of radii, depths, and spacing suitable to achieve the desired performance characteristics of the paintball.

Figure 7:
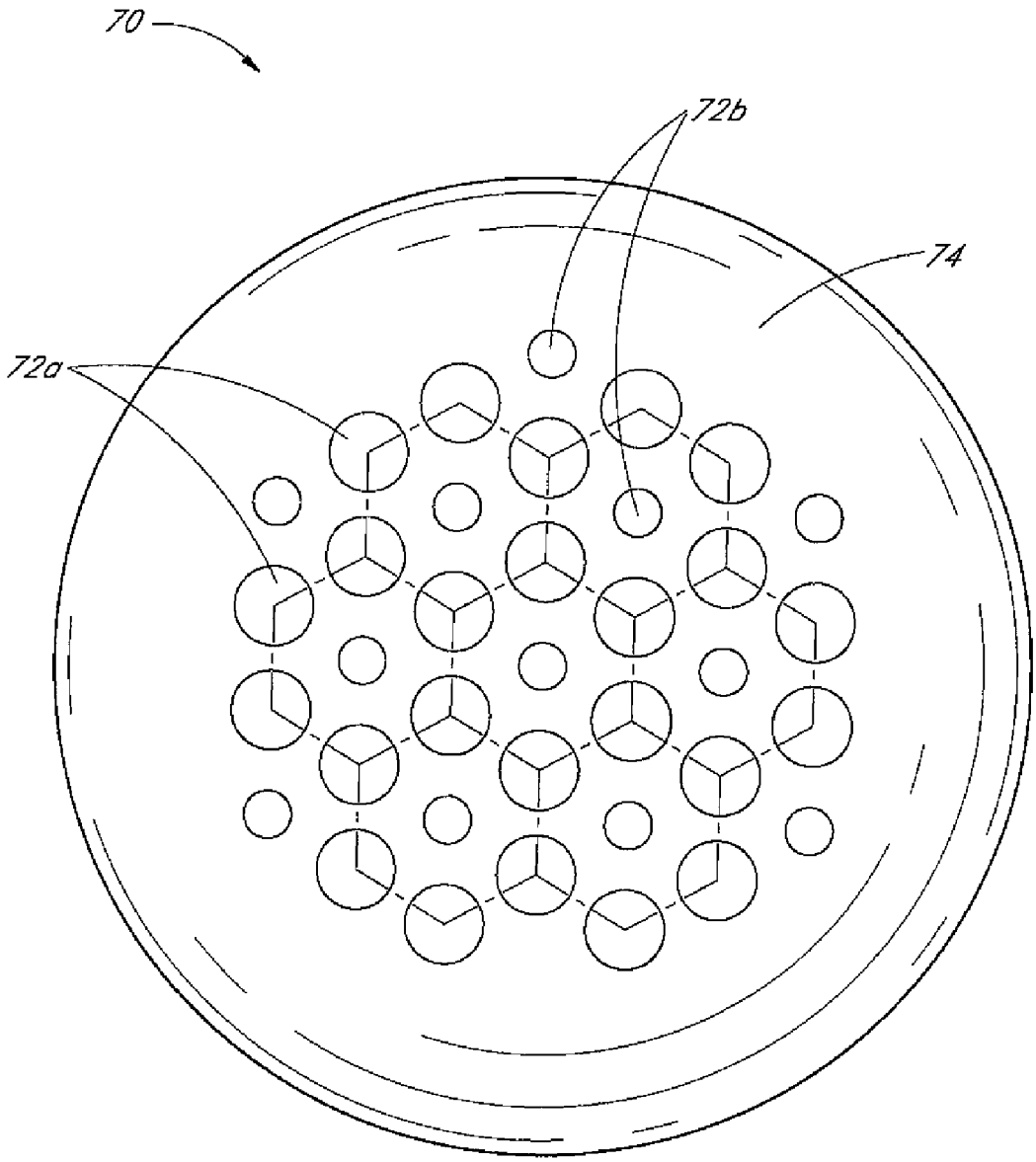
FIG. 7 is a perspective view of another embodiment of a paintball.

FIG. 7 depicts a perspective view of a paintball 70 having a plurality of dimples 72*a* preferably generally arranged on the surface 74 thereof in hexagonal patterns around dimples 72*b*. As illustrated, the dimples 72*a* preferably have a radius and depth that is greater than the radius and depth of dimples 72*b*. Without limitation, the illustrated hexagonal pattern preferably covers the entire surface 74 of the paintball 70. In other embodiments, the radius and depth of dimples 72*a* can be equal to or less than the dimples 72*b*. Further, in other embodiments, the spacing between the dimples 72*a,b* can be equal to, greater than, or less than the spacing in the illustrated embodiment.

Figure 8:
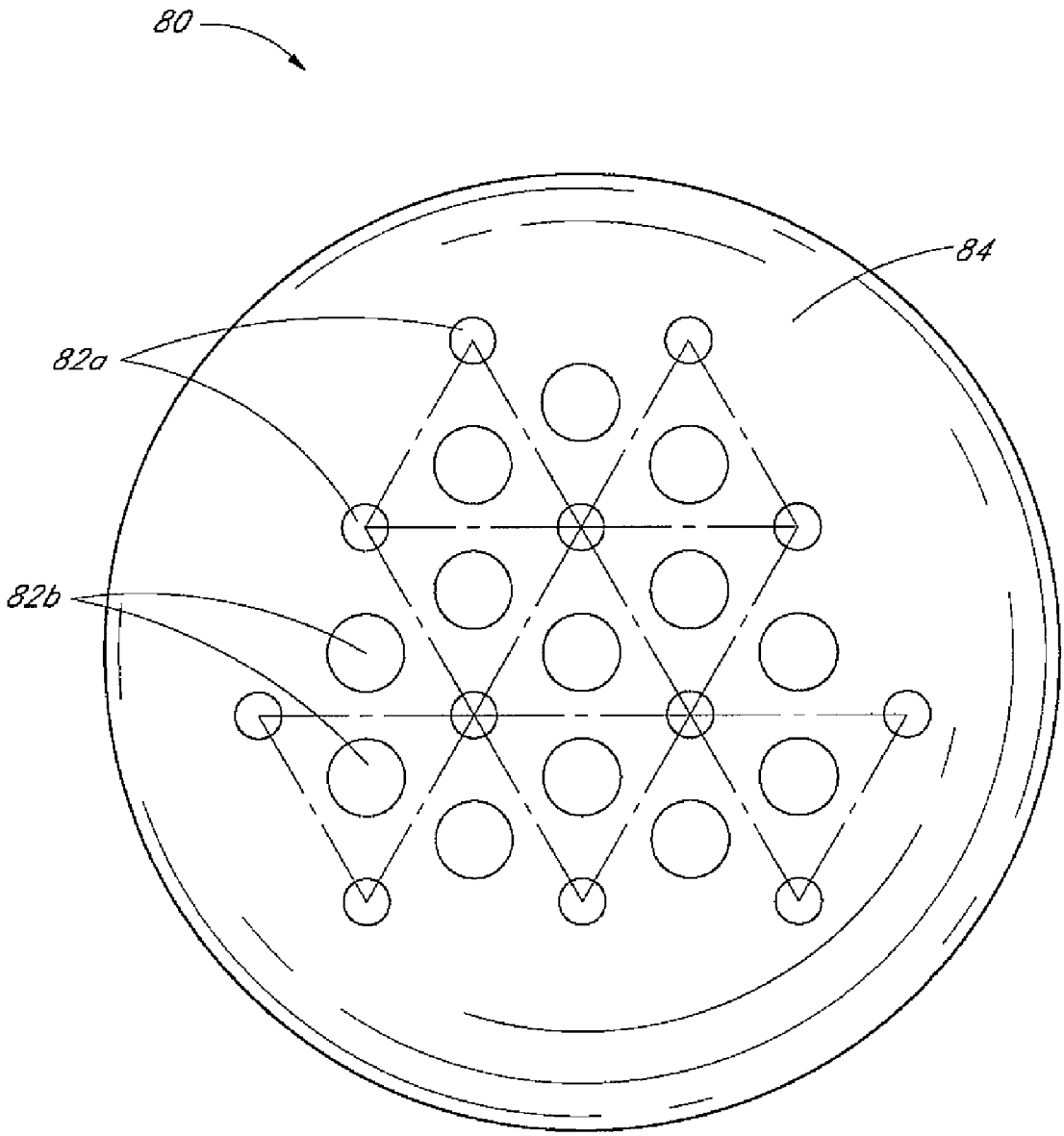
FIG. 8 is a perspective view of another embodiment of a paintball.

FIG. 8 depicts a perspective view of a paintball 80 preferably having a plurality of dimples 82*a* generally arranged on the surface 84 thereof in triangular patterns around dimples 82*b*. As illustrated, the dimples 82*a* preferably have a radius and depth that is less than the radius and depth of dimples 82*b*. Without limitation, the illustrated triangular pattern preferably covers the entire surface 84 of the paintball 80. In other embodiments, the radius and depth of dimples 82*a* can be equal to or greater than the dimples 82*b*. Further, in other embodiments, the spacing between the dimples 82*a,b* can be equal to, greater than, or less than the spacing in the illustrated embodiment. In other embodiments, the dimples can be arranged according to shapes other than hexagons or triangles, such as circles, squares, rectangles, pentagons, or other polygons or suitable shapes.

Figure 9A:
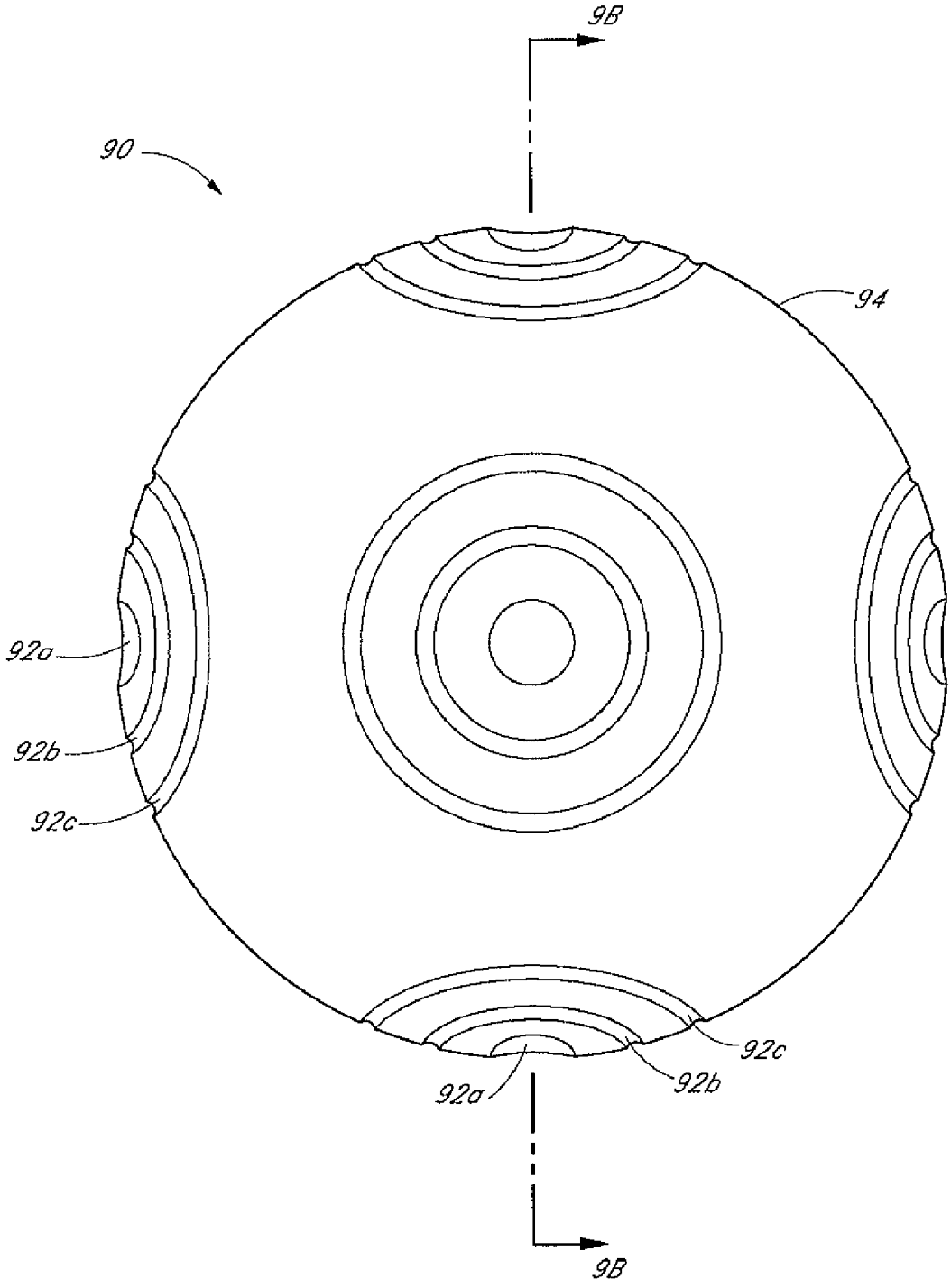
FIG. 9A is a perspective view of another embodiment of a paintball.
Figure 9B:
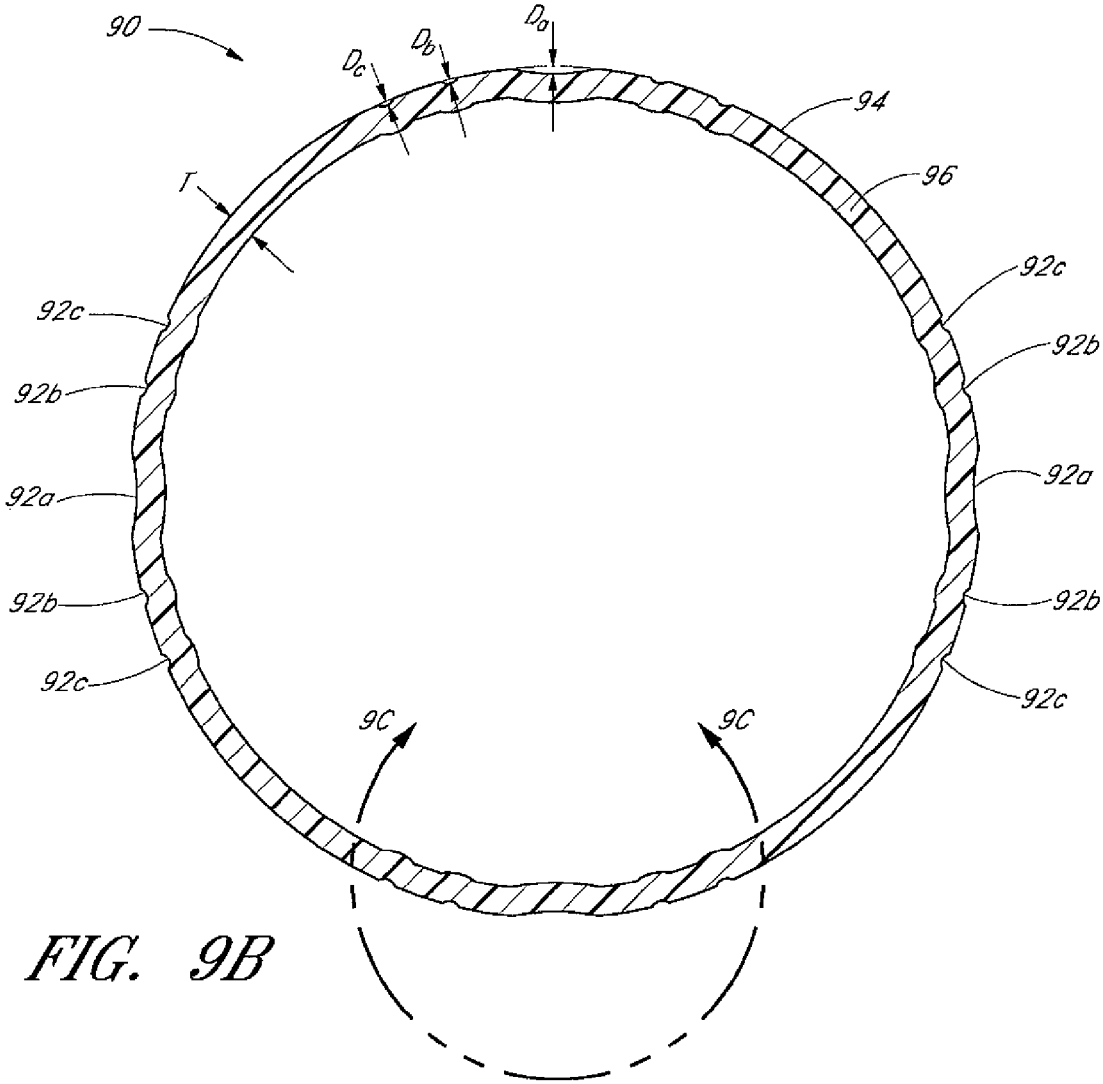
FIG. 9B is a sectional view of the paintball of FIG. 9A taken along the line 9B-9B shown in FIG. 9A and showing a total of six dimple regions generally arranged at 90° intervals around the circumference.
Figure 9C:
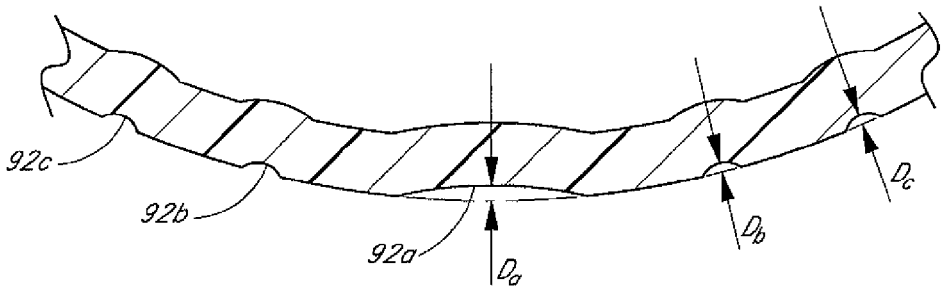
FIG. 9C is an enlarged partial sectional view of the paintball shown in FIG. 9B.

FIGS. 9A-9C depict a perspective view and cross-section, respectively, of a paintball 90 preferably having a total of six dimples 92*a* generally arranged at 90° intervals on the surface 94 thereof, as shown. The illustrated paintball 90 preferably also has a total of six annular or linear dimples 92*b* and six annular or linear dimples 92*c*. Each dimple 92*b,c* may be generally arranged concentrically about each dimple 92*a*, as shown. In the illustrated embodiment, the depth of each dimple 92*a,b,c* (i.e., the depth $D_a$ of each dimple 92*a*, the depth $D_b$ of each dimple 92*b*, the depth $D_c$ of each dimple 92*c*) may be approximately equal to 25% of the thickness T of the shell 96. However, in other embodiments, the depth D of each dimple 92*a,b,c* can be non-uniform. For example, one or more dimples can have a depth that is equal to, greater than, or less than 25% of the thickness T of the shell 96. Further, other embodiments of the paintball 90 can have more or less dimples other than the dimples 92 illustrated in FIGS. 9A and 9B. For example, in another embodiment, the paintball 90 can have six additional annular dimples, each arranged concentric to each of the six dimples 92*a*.

Any of the embodiments of the paintballs disclosed herein can be manufactured according to any suitable process or technique currently known in the art or later developed. For example, without limitation, some embodiments of the paintballs disclosed herein can be manufactured by one or more of the following processes, in addition to any other suitable processes or techniques currently known or later developed: extrusion, blow molding, injection molding, casting, vacuum forming, thermal forming, encapsulation, and vulcanization.

It is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Furthermore, the skilled artisan will recognize the interchangeability of various features from different embodiments. For example, the alternative dimple shapes shown in FIGS. 9A-9C can be adapted for use with any of the other embodiments disclosed herein. In addition to the variations described herein, other known equivalents for each feature can be mixed and matched by one of ordinary skill in this art to construct paintballs in accordance with principles of the present invention.

Although this invention has been disclosed in the context of a certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure.

It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above.

What is claimed is:

1. A paintball comprising:

a shell having a generally spherical outer surface;

a marking substance within said shell; and a plurality of dimples formed on said outer surface;

wherein a thickness of said shell is uniform over the entire surface thereof.

2. The paintball of claim 1, wherein said outer surface defines an outer radius that is generally 0.68 inch in diameter.

3. The paintball of claim 1, wherein each of said plurality of dimples defines a maximum depth measured from said outer surface that is less than approximately 10% of a thickness of said shell.

4. The paintball of claim 1, wherein each of said plurality of dimples defines a maximum depth measured from said outer surface that is approximately 10% to approximately 20% of a thickness of said shell.

5. The paintball of claim 1, wherein each of said plurality of dimples is generally spherical in shape and defines a dimple radius.

6. The paintball of claim 5, wherein each of said plurality of dimples defines a maximum depth measured from said outer surface that is generally less than said dimple radius.

7. The paintball of claim 5, wherein said dimple radius is less than approximately 0.1 inch.

8. The paintball of claim 5, wherein said dimple radius is approximately 0.1 inch to approximately 0.5 inch.

9. The paintball of claim 5, wherein said dimple radius is approximately 0.5 inch to approximately 1 inch.

10. The paintball of claim 1, wherein a maximum depth of said dimple is approximately 0.005 inch to approximately 0.025 inch.

11. The paintball of claim 1, wherein a maximum depth of said dimple is approximately 0.025 inch to approximately 0.05 inch.

12. The paintball of claim 1, wherein approximately 20% to approximately 40% of said outer surface is covered by said plurality of dimples.

13. The paintball of claim 1, wherein approximately 40% to approximately 60% of said outer surface is covered by said plurality of dimples.

14. The paintball of claim 1, wherein each of said plurality of dimples is generally triangular, rectangular, or tetrahedral in shape.

15. The paintball of claim 1, wherein said marking substance is a colored liquid at ambient conditions.

16. The paintball of claim 1, wherein said plurality of dimples are positioned on said outer surface so as to form circular, triangular, square, hexagonal, or other polygonal patterns.

17. The paintball of claim 1, wherein said shell is comprised of a gelatinous material.

18. The paintball of claim 1, wherein said plurality of dimples are positioned on said outer surface so as to form a plurality of concentric circles.

19. A paintball comprising:

a gelatinous hollow shell having a uniform thickness and an outer surface;

a marking substance disposed in said shell; and a plurality of first dimples each defining a first size and a plurality of second dimples each defining a second size that is smaller than the first size formed on said outer surface, wherein each of the first dimples is adjacent to one or more of the second dimples.

20. The paintball of claim 19, wherein said marking substance partially fills said shell.

21. The paintball of claim 19, wherein the second dimples surround each of the first dimples in a triangular pattern.

22. The paintball of claim 19, wherein the second dimples have a depth that is less than a depth of the first dimples.

23. The paintball of claim 19 further comprising a plurality of third dimples formed on said outer surface, wherein the third dimples have a third size that is different than the first size and the second size.

24. A method of forming a paintball, comprising the steps of:

forming a quantity of a marking substance into a desired shape; and forming a shell around said marking substance, said shell having a uniform thickness and an outer surface that is generally spherical in shape and includes a plurality of dimples formed on said outer surface;

wherein the foregoing steps can be performed in any desired order.

25. A method of forming a paintball, comprising the steps of:

foaming a shell having a uniform thickness, the shell comprising a generally spherically shaped outer surface and a marking substance only partially filling said shell, said shell having a plurality of dimples formed on said outer surface.

* * * * *

UNITED STATES PATENT AND TRADEMARK OFFICE

CERTIFICATE OF CORRECTION

PATENT NO. : 7,882,786 B2
APPLICATION NO. : 12/207255
DATED : February 8, 2011
INVENTOR(S) : David DeHaan et al.

It is certified that error appears in the above-identified patent and that said Letters Patent is hereby corrected as shown below:

Column 5, line 60, Change "limited" to --limited.--.

Column 8, line 52, In Claim 25, change "foaming" to --forming--.

Signed and Sealed this
Twenty-fifth Day of October, 2011

David J. Kappos

David J. Kappos
*Director of the United States Patent and Trademark Office*